US006699097B2

(12) United States Patent
Rudell et al.

(10) Patent No.: US 6,699,097 B2
(45) Date of Patent: Mar. 2, 2004

(54) TOYS WITH TIMER-ACTIVATED CONTROLLABLE OPERATION TIME

(75) Inventors: Elliot Rudell, 30507 Rhone Dr., Rancho Palos Verdes, CA (US) 90275; George T. Foster, Long Beach, CA (US)

(73) Assignee: Elliot Rudell, Torrance, CA (US)

( * ) Notice: Subject to any disclaimer, the term of this patent is extended or adjusted under 35 U.S.C. 154(b) by 52 days.

(21) Appl. No.: 09/780,110

(22) Filed: Feb. 9, 2001

(65) Prior Publication Data

US 2002/0111116 A1 Aug. 15, 2002

(51) Int. Cl.[7] ..... A63H 5/00; A63H 17/00

(52) U.S. Cl. ..... 446/297; 446/304; 446/436; 446/484

(58) Field of Search ..... 446/484, 431, 446/436, 457, 297, 304

(56) References Cited

U.S. PATENT DOCUMENTS

| | | | | | |
|---|---|---|---|---|---|
| 2,192,430 | A | | 3/1940 | Branner | |
| 3,008,712 | A | | 11/1961 | Konopka | |
| 3,176,430 | A | | 4/1965 | Ryan | |
| 3,577,675 | A | | 5/1971 | Kohner | |
| 3,735,525 | A | * | 5/1973 | Freed | 446/435 |
| 3,795,400 | A | | 3/1974 | Glass et al. | |
| 3,843,127 | A | | 10/1974 | Lack | |
| 3,866,916 | A | | 2/1975 | Clarke | |
| 3,878,639 | A | | 4/1975 | Scheelar et al. | |
| 4,040,622 | A | | 8/1977 | Sinnott | |
| 4,077,629 | A | | 3/1978 | Chestney | |
| 4,093,228 | A | | 6/1978 | Pierce | |
| 4,113,259 | A | | 9/1978 | Sands | |
| 4,212,460 | A | | 7/1980 | Kraft | |
| 4,248,009 | A | * | 2/1981 | Ferris et al. | 446/409 |
| 4,526,366 | A | | 7/1985 | Kenoun | |
| 4,545,583 | A | | 10/1985 | Pearman et al. | |
| 4,702,480 | A | | 10/1987 | Popeski et al. | |
| 4,735,239 | A | | 4/1988 | Salmon et al. | |
| 4,772,028 | A | | 9/1988 | Rockhold et al. | |
| 4,783,074 | A | | 11/1988 | Kobayashi | |
| 4,813,680 | A | | 3/1989 | Rudell et al. | |
| 4,881,733 | A | | 11/1989 | Rehkemper et al. | |
| 4,890,838 | A | | 1/1990 | Rudell et al. | |
| 4,991,847 | A | | 2/1991 | Rudell et al. | |
| 5,037,345 | A | * | 8/1991 | Nakayama | 446/297 |
| 5,074,437 | A | | 12/1991 | D'Andrade et al. | |
| 5,135,440 | A | | 8/1992 | Smollar et al. | |
| 5,137,175 | A | | 8/1992 | Kowalski et al. | |
| 5,154,671 | A | | 10/1992 | Smollar et al. | |
| D334,044 | S | | 3/1993 | Lopatin | |
| 5,230,517 | A | | 7/1993 | Peacock | |
| 5,256,099 | A | | 10/1993 | Rudell et al. | |
| 5,263,714 | A | | 11/1993 | Rudell et al. | |
| 5,277,642 | A | | 1/1994 | Dorta | |
| 5,354,225 | A | | 10/1994 | Hix | |
| 5,390,913 | A | | 2/1995 | Kepler | |
| 5,405,294 | A | | 4/1995 | Briggs | |
| 5,413,518 | A | * | 5/1995 | Lin | 273/460 |
| 5,429,369 | A | | 7/1995 | Hurst | |
| 5,433,646 | A | | 7/1995 | Tarng | |

(List continued on next page.)

*Primary Examiner*—Jacob K. Ackun
(74) *Attorney, Agent, or Firm*—Irell & Manella, LLP

(57) ABSTRACT

A timer activated toy that has a "run time" which correlates to the time interval of a user input. The toy may include both a button which can be depressed for a time interval and a switch that can be switched to an on position. The toy may have a motor or electronic sound circuit that is activated when the switch is turned on and a counter that counts to a count value after the button is depressed. The motor is deactivated when the counter reaches the count value. The toy will thus be activated for an interval that corresponds to the time the button is depressed. This correlation simulates filling a "gas tank" of the toy.

19 Claims, 2 Drawing Sheets

U.S. PATENT DOCUMENTS 5,458,524 A * 10/1995 Lucas ..... 446/297
5,482,292 A 1/1996 Stone
5,529,525 A 6/1996 Deal
5,531,626 A 7/1996 Deal
5,538,456 A 7/1996 Liu et al.
5,611,460 A 3/1997 Rudell
5,713,741 A * 2/1998 DeMars ..... 434/319
5,722,660 A 3/1998 Rudell et al.
5,785,592 A 7/1998 Jacobsen
5,823,849 A 10/1998 Gardner et al.
5,839,964 A 11/1998 Rudell et al.
5,839,981 A 11/1998 Rudell et al.
5,893,562 A 4/1999 Spector
5,992,853 A 11/1999 Rudell et al.
6,048,209 A * 4/2000 Bailey ..... 434/238
6,188,311 B1 * 2/2001 Rothschild ..... 340/309.15

* cited by examiner

TOYS WITH TIMER-ACTIVATED CONTROLLABLE OPERATION TIME

BACKGROUND OF THE INVENTION

1. Field of the Invention

The present invention relates to timer operated toys.

2. Background Information

There have been developed toys that operate in conjunction with the quantity of input from a child. For example, Ideal Toy Corp. marketed a line of toy vehicles under the trademark GUZZLERS, that allowed a user to fill a "gas tank" with water. The vehicles would run for a time period that corresponded to the amount of water in the tank.

There have also been marketed electronic pets that require care by a child. With electronic pets a child must depress a button(s) to simulate an activity such as eating. The pets have an electronic display that can provide expressions indicating whether the child has performed the required care. None of these pets provide a correlation between the operation of the toy and the amount of time that the button is depressed.

BRIEF SUMMARY OF THE INVENTION

One embodiment of the present invention is a timer activated toy which has a switch that can be switched to an on position. The toy also has an input device that can receive an input for a time interval. A counter may count to a count value once the switch is switched to the on position. The value of the count corresponds to the time interval of the input. The state of an output device is switched when the switch is turned to the on position. The output device switches states again when the counter reaches the count value.

DETAILED DESCRIPTION OF THE PREFERRED EMBODIMENT

In general the present invention includes a timer activated toy that has a "run time" which correlates to the time interval of a user input. The toy may include both a button which can be depressed for a time interval, and a switch that can be switched to an on position. The toy may have a motor that is activated when the switch is turned on and a counter that counts to a count value after the button is depressed. The motor is deactivated when the counter reaches the count value. The toy will thus be activated for an interval that corresponds to the time the button is depressed. This correlation simulates filling a "gas tank" of the toy.

Figure 1:
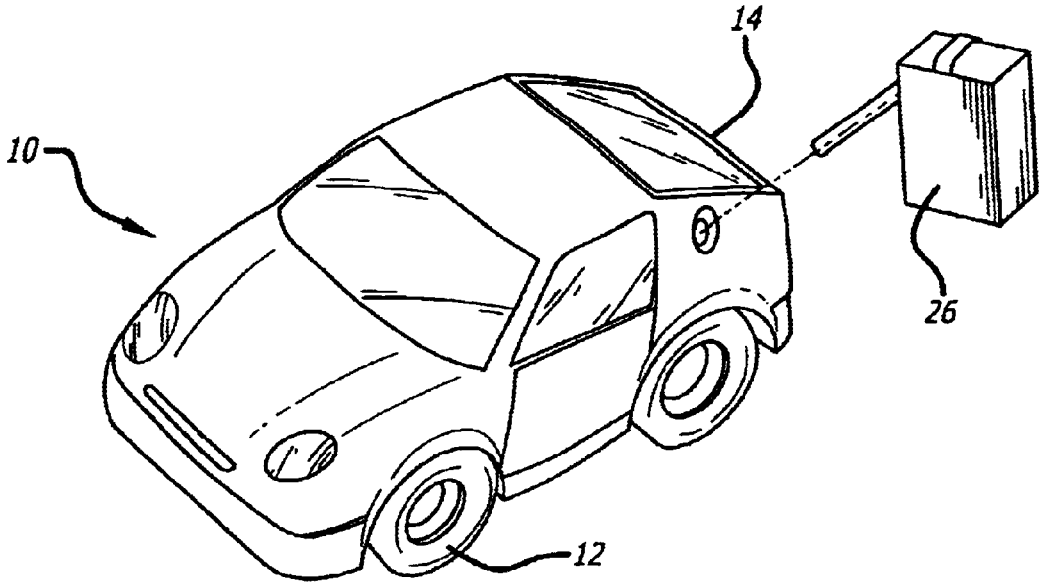
FIG. 1 is a perspective view of an embodiment of a toy of the present invention.
Figure 2:
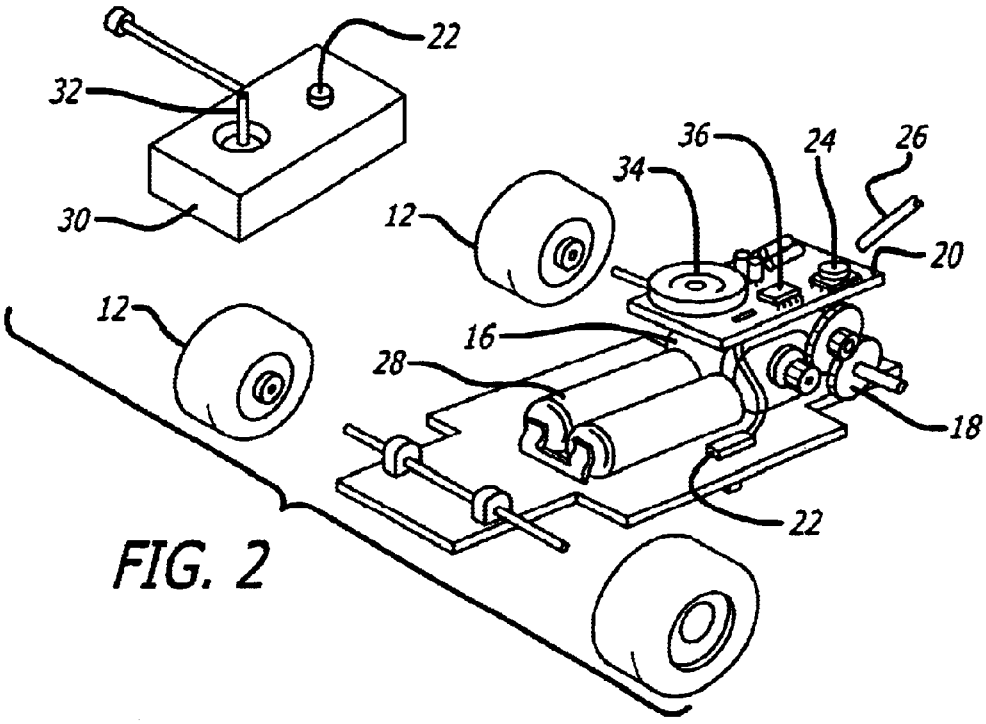
FIG. 2 is an exploded view of the toy shown in FIG. 1.

Referring to the drawings more particularly by reference numbers, FIGS. 1 and 2 show an embodiment of a toy 10 of the present invention. The toy 10 may be constructed as a toy vehicle that has a plurality of wheels 12 coupled to a body 14. At least one of the wheels 12 may be coupled to a motor 16 by a gear train 18. The motor 16 can be switched between an active state and an inactive state by a printed circuit board assembly 20. The toy 10 may further have a switch 22 that is connected to the printed circuit board assembly 20 and attached to the body 14. The circuit board assembly 20 may include a button 24 that simulates the gas port of a "fuel tank". The button 24 can be depressed by a toy gas can 26.

The toy 10 may have batteries 28 that can provide power to the printed circuit board assembly 20 and the motor 16. The switch 22 can be switched between an on position and an off position to control power to the assembly 18 and/or motor 16. Although the switch 20 is shown attached to the body 14, it is to be understood that toy 10 may have a switch 22 located in a remote controller 30. The remote controller 30 may also have a stick 32 that transmits signals to the toy and allows a user to operate and control the toy vehicle 10.

The printed circuit board assembly 20 may also have a speaker 34 that can emit sound. The assembly 20 may have one or more integrated circuits 36 and other electrical components to control the toy vehicle.

Figure 3:
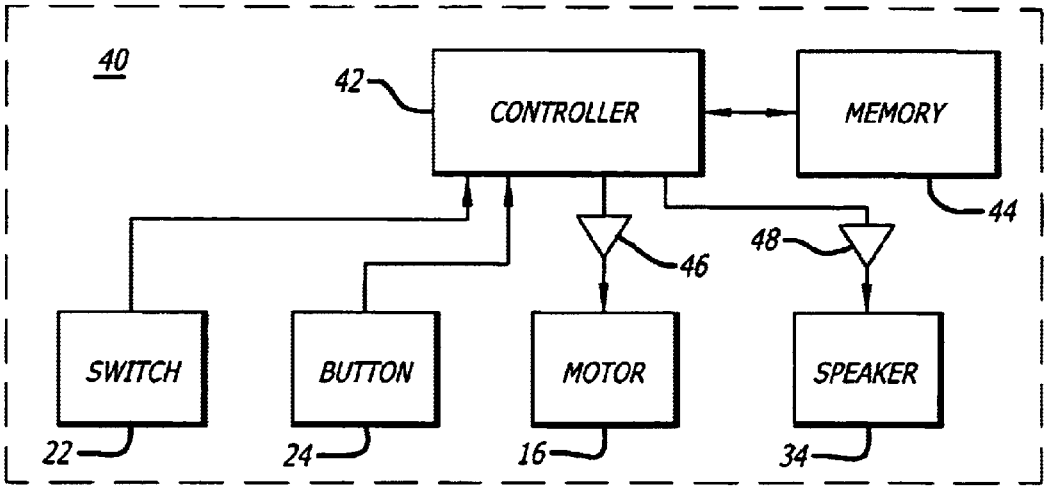
FIG. 3 is a schematic of an electrical system of the toy.

FIG. 3 shows an exemplary electrical system 40 of the toy 10. The system 40 may include a controller 42 that is connected to memory 44. The controller 42 may receive input signals from the switch 22 and button 24. Alternatively, the switch 22 may couple the controller 42 to the batteries (not shown). The controller 42 may provide output signals to a motor driver 46 and speaker driver 48 coupled to the motor 16 and speaker 34, respectively.

The controller 42 may be a microprocessor that operates in accordance with instructions and data provided by memory 44. Memory 44 may include both volatile and non-volatile memory. The controller 42 can function as a counter that counts to a count value. The count value corresponds to the time that the button 24 is depressed. Although a microprocessor is described, it is to be understood that the controller 42 could be replaced by a counter and associated circuits.

The controller 42 and memory 44 may also function as a speech synthesizer that drives the speaker 34 to generate "speech" or noises.

In operation, a child may "pour" gas into the gas tank of the toy vehicle by depressing the button 24 with the gas can 26. The controller 42 creates a count value that corresponds to the time interval the button 24 is depressed. A longer time interval may correspond to a larger count value. The controller 42 may drive the speaker 34 to emit noises such as "gulp, gulp" while the button 24 is depressed to simulate the pouring of gas into a gas tank 26.

When the switch 22 is turned on the controller 42 may activate the motor 16 and begin counting. The controller 42 may either count up to the count value, or count down from the count value. The speaker 34 may emit sounds that simulate the running of an engine during operation of the toy 10. The controller 42 can deactivate the motor 16 when the count reaches the count value. Thus the toy will operate for a time period that corresponds to the amount of time the user depressed the button (filled the gas tank). The controller 42 may sequentially deactivate, activate, deactivate, etc. the motor before reaching the count value to simulate a vehicle running out of gas. The controller 42 may also drive the speaker 34 to emit sounds that simulate an engine running out of gas. The toy 10 may have a display, such as a liquid crystal display (LCD), that provides an indication of the amount of fuel in the car. The fuel level corresponds to the present value of the controller counter.

Figure 4:
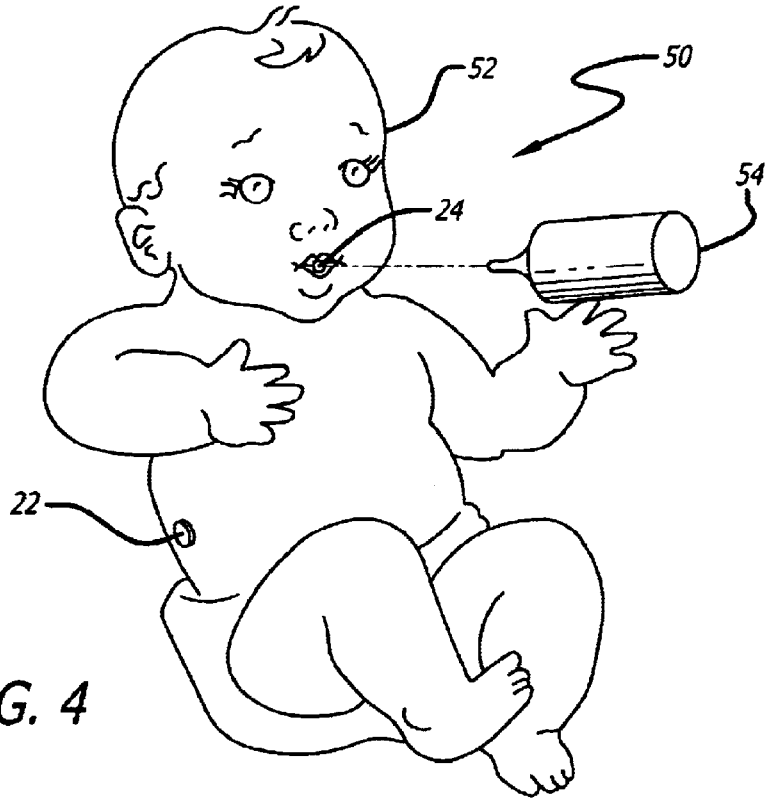
FIG. 4 is a perspective view of an alternate doll embodiment of the toy.

FIG. 4 shows an alternate embodiment of the toy incorporated into a doll 50. The doll 50 may have a baby doll body 52. The button 24 may be located within the mouth of the body 52. The button 24 may be depressed by a toy bottle 54. Alternatively, the button 24 may be depressed by a toy spoon or other utensil. Instead of the bottle 54, the activation of the button 24 could be the child holding the doll, or holding the doll's hand and depressing a switch that would record the count value. The amount of time the doll was thereby embraced or held by the child could determine the response activation circuit time.

The electrical system shown in FIG. 2 may be integrated into the doll body 52. The toy doll 50 may, or may not, have a motor to actuate the limbs and/or head of the body 52. The doll 50 may also have a switch 22.

In operation, a child may depress button 24 with the bottle. The length of the time and/or number of times that the button 24 is depressed may define the count value. The doll 50 may emit "happy" sounds while the button 22 is depressed.

After a switch (not shown) is activated the controller may count to the count value. Upon reaching the count value the doll may emit sounds simulating a baby crying to indicate hunger. The count value corresponds to the depression of the button, so that an increase in the time interval, or number of times, that the button is depressed, simulates the consumption of more food and a longer period between "feedings".

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

For example, although separate switches 22 and buttons 24 were shown and described, it is to be understood that the present invention may be utilized with a single input device that provide both functions. For example, the toy or doll may have a single button that provided the functions of the switch 22 and button 24.

What is claimed is:

1. A toy, comprising:

a housing;

an input device that is coupled to said housing and can receive an input from a user;

an electronic counter that is coupled to said input device and counts to a count value, said count value corresponds to time that said input device received input from the user; and, a switch that causes said electronic counter to count to said count value; and, an output device that initially switches states at the beginning of said count value, and switches states again when the electronic counter counts to said count value.

2. The toy of claim 1, wherein said input device is a button.

3. The toy of claim 1, wherein said output device is a motor.

4. The toy of claim 1, wherein said output device is a speaker.

5. The toy of claim 4, wherein said electronic counter is integrated into a controller that is coupled to said output device, said controller provides speech synthesis.

6. The toy of claim 1, wherein said electronic counter is integrated into a controller that sequentially switches the states of said output device as said counter approaches the count value.

7. The toy of claim 1, wherein said output device is activated during the receipt of the signal by said input device.

8. A toy vehicle, comprising:

a vehicle shaped body;

a plurality of wheels coupled to said body;

a button that is coupled to said body and can be depressed by a user;

an electronic counter that is coupled to said button and counts to a count value, said count value corresponds to a time that the user depresses the button;

a switch that causes said electronic counter to count to said count value; and, a motor that is coupled to said body and said wheels, said motor is initially activated at the beginning of said count value and is deactivated when the electronic counter counts to said count value.

9. The toy vehicle of claim 8, further comprising a speaker coupled to said body.

10. The toy vehicle of claim 9, wherein said electronic counter is integrated into a controller that is coupled to said speaker, said controller provides speech synthesis.

11. The toy vehicle of claim 8, wherein said electronic counter is integrated into a controller that sequentially activates and deactivates said motor as said counter approaches the count value.

12. The toy vehicle of claim 9, wherein said speaker emits a sound when said button is depressed.

13. A doll, comprising:

a body;

a button that is coupled to said body and can be depressed by a user;

an electronic counter that is coupled to said button and counts to a count value, said count value corresponds to a time that the user depresses the button;

a switch that causes said electronic counter to count to said count value; and, an output device that is coupled to said body and initially switches states at the beginning of said count value, and switches states again when the electronic counter counts to said count value.

14. The doll of claim 13, wherein said electronic counter is integrated into a controller that is coupled to said speaker, said controller providing speech synthesis.

15. The doll of claim 13, wherein said electronic counter is integrated into a controller that sequentially activates and deactivates said speaker as said counter approaches the count value.

16. The doll of claim 13, wherein said output device is a speaker.

17. The doll of claim 16, wherein said speaker emits a sound when said input device is depressed.

18. A method for operating a toy, comprising:

receiving a input from a user;

counting with an electronic counter to a count value that corresponds to a time that the input is received;

switching a state of an output device;

counting to the count value; and, switching the states of the output device when the count reaches the count value.

19. The method of claim 18, further comprising sequentially switching states of the output device for a predetermined count interval before the count value.

* * * * *